US005865312A

United States Patent [19]

Stall

[11] Patent Number: 5,865,312

[45] Date of Patent: Feb. 2, 1999

[54] PACKAGING OF SHIRRED FOOD CASING

[75] Inventor: Alan David Stall, Naperville, Ill.

[73] Assignee: Alfacel s.a, Madrid, Spain

[21] Appl. No.: 682,316

[22] Filed: Jul. 17, 1996

[51] Int. Cl.[6] ..... B65D 85/20

[52] U.S. Cl. ..... 206/443; 206/499; 206/802

[58] Field of Search ..... 206/443, 499, 206/802; 414/790.8; 53/447

[56] References Cited

U.S. PATENT DOCUMENTS

| | | | |
|---|---|---|---|
| 1,036,282 | 8/1912 | Lilienfeld . | |
| 1,070,776 | 8/1913 | Cohoe et al. . | |
| 1,158,400 | 10/1915 | Cohoe . | |
| 1,163,740 | 12/1915 | Cohoe . | |
| 1,251,598 | 1/1918 | Vale . | |
| 1,601,686 | 9/1926 | Henderson . | |
| 1,612,508 | 12/1926 | Henderson et al. . | |
| 1,645,050 | 10/1927 | Henderson . | |
| 1,654,253 | 12/1927 | Henderson . | |
| 1,705,059 | 3/1929 | Hintz | 206/499 |
| 2,001,461 | 4/1935 | Hewitt . | |
| 2,001,478 | 5/1935 | Vogt | 206/499 |
| 2,010,626 | 8/1935 | Dietrich . | |
| 2,181,329 | 11/1939 | Hewitt . | |
| 2,583,654 | 1/1952 | Korsgaard . | |
| 2,682,475 | 6/1954 | Smith . | |
| 2,722,714 | 11/1955 | Blizzard et al. . | |
| 2,784,544 | 6/1957 | Firth . | |
| 2,979,246 | 4/1961 | Liebeskin . | |
| 2,983,949 | 5/1961 | Matecki . | |
| 2,999,756 | 9/1961 | Shiner et al. . | |
| 2,999,757 | 9/1961 | Shiner et al. . | |
| 3,028,952 | 4/1962 | Milio et al. . | |
| 3,110,058 | 11/1963 | Marbach . | |
| 3,148,992 | 9/1964 | Hewitt . | |
| 3,206,020 | 9/1965 | Billingsley et al. . | |
| 3,218,764 | 11/1965 | Deeren et al. . | |
| 3,233,815 | 2/1966 | Eggen . | |
| 3,250,629 | 5/1966 | Turbak . | |
| 3,271,168 | 9/1966 | Alsys . | |
| 3,283,893 | 11/1966 | Durocher et al. | 206/499 |
| 3,321,072 | 5/1967 | Alsys . | |
| 3,342,322 | 9/1967 | Weisner et al. . | |
| 3,397,069 | 8/1968 | Urbutis et al. . | |
| 3,454,982 | 7/1969 | Arnold . | |
| 3,471,305 | 10/1969 | Marbach . | |
| 3,528,825 | 9/1970 | Doughty . | |
| 3,616,989 | 11/1971 | Martinek et al. . | |
| 3,764,351 | 10/1973 | Whittington et al. . | |
| 3,835,113 | 9/1974 | Burke et al. . | |
| 3,898,348 | 8/1975 | Chiu et al. . | |
| 3,971,187 | 7/1976 | McNeil et al. . | |
| 4,381,643 | 5/1983 | Stark . | |
| 4,590,107 | 5/1986 | Bridgeford . | |
| 4,648,513 | 3/1987 | Newman . | |
| 4,747,485 | 5/1988 | Chaussadas | 206/427 |
| 4,778,639 | 10/1988 | Joe et al. . | |
| 4,817,797 | 4/1989 | Hamelin | 206/427 |
| 5,137,153 | 8/1992 | Hendriks . | |
| 5,228,572 | 7/1993 | Hendriks . | |
| 5,356,007 | 10/1994 | Feldt . | |
| 5,358,765 | 10/1994 | Markulin . | |
| 5,372,299 | 12/1994 | Edgerton, Jr. et al. | 206/427 |
| 5,381,643 | 1/1995 | Kazaitis et al. | 53/447 |
| 5,382,190 | 1/1995 | Graves . | |
| 5,391,108 | 2/1995 | Feldt . | |
| 5,467,576 | 11/1995 | Hendriks . | |

*Primary Examiner*—David T. Fidel

*Attorney, Agent, or Firm*—Marshall, O'Toole, Gerstein, Murray & Borun

[57] ABSTRACT

Disclosed herein are caddies and methods for loading caddies with food casings in a manner that provides optimum food casing support. The caddy includes opposite side panels having alternating support surfaces for supporting alternating rows of n and n−1 food casings.

16 Claims, 3 Drawing Sheets

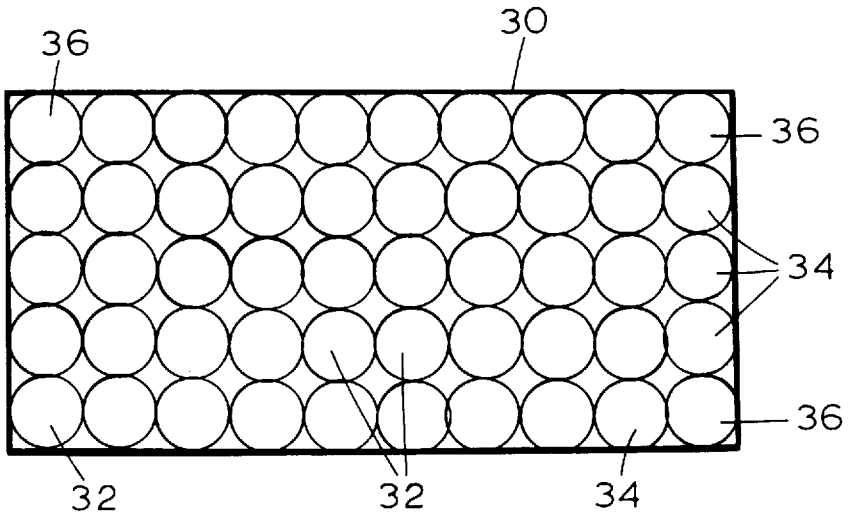
FIG. 1
FIG. 2
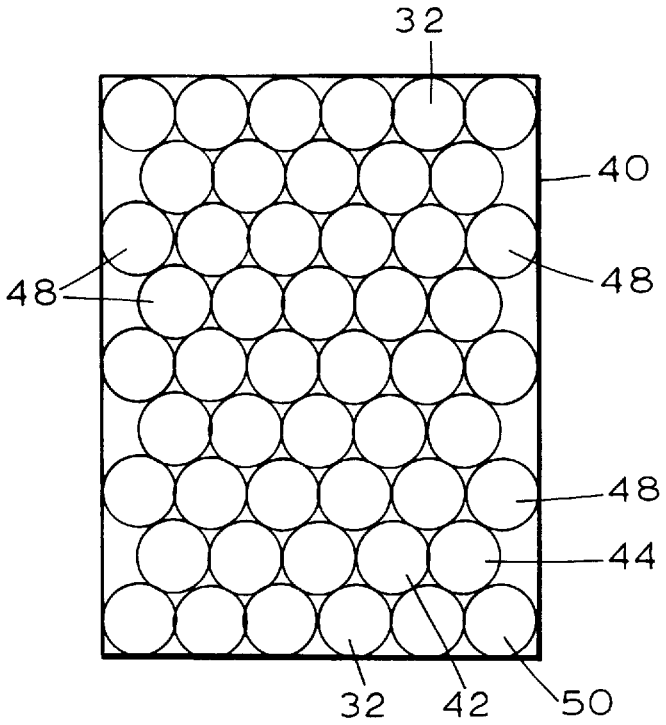

PACKAGING OF SHIRRED FOOD CASING

BACKGROUND OF THE INVENTION

This invention relates to an improved means of packaging shirred cellulose casing, normally referred to as skinless sausage casing.

Tubular cellulosic casing is well-known, and has been widely used for many years by numerous manufacturers. The basic process for manufacturing regenerated cellulosic casings is through the well-known viscose process, which creates a liquefied colloidal dispersion of cellulose fibers in an alkaline liquid carrier. Viscose is described in U.K. Patent 8700 to Cross, Bevan and Beadle, and U.S. Pat. No. 1,036,282 to Lilienfield refines the viscose compositions. U.S. Pat. Nos. 1,070,776; 1,158,400; and 1,163,740 to Cohoe and Fox describe use of viscose to manufacture a tubular cellulosic casing. Henderson provides basic technology to manufacture viscose into tubular casings, with regenerating baths contacting the inner and outer surfaces of the tube in U.S. Pat. Nos. 1,601,686; 1,612,508; 1,645,050; and 1,654,253.

Very specific details for manufacture of modern-day casings from viscose into regenerated cellulose are shown in U.S. Pat. Nos. 2,999,756 and 2,999,757 to Shiner; 3,835,113 to Burke; 4,590,107 to Bridgeford; 4,778,639 to Jon; and 5,358,765 to Markulin. All of these patents describe extruding viscose (sodium cellulose xanthate, sodium hydroxide, water) through an annular die, into a coagulating and regenerating bath, to produce a regenerated cellulosic tubular casing.

The artificial sausage casing is conventionally shirred, where long tubular lengths are compacted to provide shorter, coherent tubes. The coherency is important, so the casing stick is straight and rigid, and is difficult to achieve considering the shirring operation includes moisturizing and oil addition. The shirring operation is illustrated U.S. Pat. Nos. 2,001,461; 2,010,626; 2,583,654; 2,722,714; 2,983,949; 3,110,058; 3,397,069; 3,454,982; and 3,898,348.

Small diameter shirred food casings must be packaged for distribution and sale, and this packaging is critical to the performance when the shirred product is filled with meat paste using high speed filling machines. The casing has a thickness of 20 to 40 microns and can be damaged easily. The casing may be used from one day to up to one year past shirring so, in the meantime, the shirred casing sticks must be rigidly supported to prevent dimension deformation, survive the rigors of transportation, and yet be easily dispensed without much waste packaging.

The stuffing operation will handle casing sticks typically from 265 mm length to 546 mm length, containing casing from 16.5 meters up to, and in excess of, 69 meters. Thus, one shirred casing stick could provide in excess of 500 frankfurters.

Many factors are required of packaging:

Rigid support of casing sticks, to prevent lateral abrasion and motion, and dimensional changes such as curving, bowing, and casing stick coherency loss (pleats un-nest and come apart);

Retention of moisture in the shirred casing stick;

Easy opening and dispensing;

Easy disposal or recyclability;

Minimum package volume, for easy transportation and storage;

Support for normal length and diameter variations of the shirred product; and

Protection against casing sticks accidentally being wetted in the stuffing room.

It is convention to package the shirred casing sticks in quantities of fifty sticks, called a caddy. Multiple caddies then make a carton, with typical cartons containing four, six or eight caddies, depending upon weight and convention. Meat packers prefer the fifty casing sticks per caddy size, for ordering and recordkeeping, and for conventional experience, but in some cases caddies of twenty-five or thirty-five casing sticks are used. Often, cartons are opened outside of the meat kitchen and caddies are individually carried into the kitchen. Sometimes, entire cartons are brought in.

Various packaging alternatives have been used. Simple bundling of tubular items is shown in U.S. Pat. Nos. 1,251,598; 2,181,329; 2,794,544; and 3,028,952 show a means to package casing sticks in a caddy, allowing external holes for moisturizing post-packaging. Multilayer packages are illustrated by U.S. Pat. Nos. 2,682,475 and 3,233,815. Foam-padded cartons are shown in U.S. Pat. No. 2,979,246. U.S. Pat. No. 3,148,992 shows pulling a leading or tail end into a caddy to package the shirred casing sticks. U.S. Pat. No. 3,206,020 shows shrink wrapping of tubular products. U.S. Pat. No. 3,218,764 shows overwrapping cylindrical tubes with a container, creating a circular cross section, cylindrically-shaped package. U.S. Pat. Nos. 3,250,629 and 3,271,168 show adding moisturizing agents inside the package, to increase shirred casing moisture in the package. U.S. Pat. No. 3,321,072 shows a cardboard caddy which can dispense from the top or the sides. U.S. Pat. No. 3,342,322 shows a caddy with the shirred casing sticks overwrapped in a plastic sling and a telescoping box caddy being used. U.S. Pat. No. 3,471,305 shows adding foam into the caddy for casing stick cushioning. U.S. Pat. No. 3,528,825 shows individual shrink overwrapping for each shirred casing stick. U.S. Pat. No. 3,616,989 shows a telescoping box caddy, with side dispensing option. U.S. Pat. No. 3,764,351 shows a primarily plastic caddy, with shrink plastic overwrap. U.S. Pat. No. 3,971,187 shows a vacuum evacuated caddy. U.S. Pat. No. 4,648,513 discloses a tear-open carton.

U.S. Pat. Nos. 5,137,153; 5,228,572; 5,356,007; 5,381,643; 5,382,190; 5,391,108; and 5,467,576 all show various versions of an all-plastic hexagon caddy, some with easy-open adhesive tapes and others with perforated openings.

The above patents disclose various methods of using cardboard and plastic. However, many deficiencies have been noted. First, regarding the all-plastic caddies, they generally have a hexagonal shape to ensure the plastic overwrap is tightly bundled around the casing stick. Without the benefit of cushioning or cardboard, the plastic must be maintained tight around the casing sticks, to prevent any motion. Conventional cartons are rectangular in shape, so when hexagonal caddies are inserted, there are airspaces and gaps which allow undesirable motion. The hexagonal caddies are not easily reusable, and once opened do not store partial caddies well. The plastic, which is covered with mineral oil, is not biodegradable as is paper, and cannot often be recycled. Further, the casing sticks can enter the caddy very warm, often reaching 55 degrees Celsius, and can stick to the plastic, particularly when the plastic is heat shrunk around the casing stick.

Thus, there is a need for a conventionally sized casing caddy that provides support for the casings during shipping and handling while retaining moisture for the casing sticks.

SUMMARY OF THE INVENTION

In accordance with the present invention there is disclosed a caddy for storing and shipping a plurality of shirred food casings, all of which are substantially equal in diameter and length with their longitudinal axes substantially parallel and their ends substantially coplanar, the caddy comprising: a substantially flat bottom panel having a first edge and a second edge; a first side panel extending upward from the first edge and having a first row support surface adjacent the bottom panel and an angular surface extending upwardly and inwardly from the first row support surface; a second side panel extending upward from the second edge and having a first row support surface adjacent the bottom panel and an angular surface extending upwardly and inwardly from the first row support surface, such that n food casings can be positioned between the first row support surfaces of the first and second side panels, and n−1 food casings can be positioned on top of the first row of food casings; and a substantially flat top panel joined to the first and second side panels.

Another embodiment of the caddy may include a flat bottom panel and side panels that each have coplanar first and second row support surfaces and an angular surface extending upwardly and inwardly from the first and second row support surface, such that in each of the first two rows there can be stored n food casings and in the third row there can be n−1 food casings.

For each of these embodiments, additional alternating row support surfaces can be added which define alternating rows of n and n−1 food casings. The support surfaces may be formed integrally with each other or may be made of separate pieces that may or may not be attached to a flat wall. A method of stacking and packaging casings in this manner is also provided.

Further, the caddy may be lined with a plastic sheet or bag that conforms to the shape of the caddy to retain moisture in the food casing sticks, and to allow the casing sticks to be moved while in the plastic bag, eliminating the need to take cardboard into the sausage kitchen.

BRIEF DESCRIPTION OF DRAWINGS

FIG. 1 is an end view of a prior art casings caddy;

FIG. 2 is an end view of another prior art casings caddy;

DETAILED DESCRIPTION OF THE DRAWINGS

Figure 3:
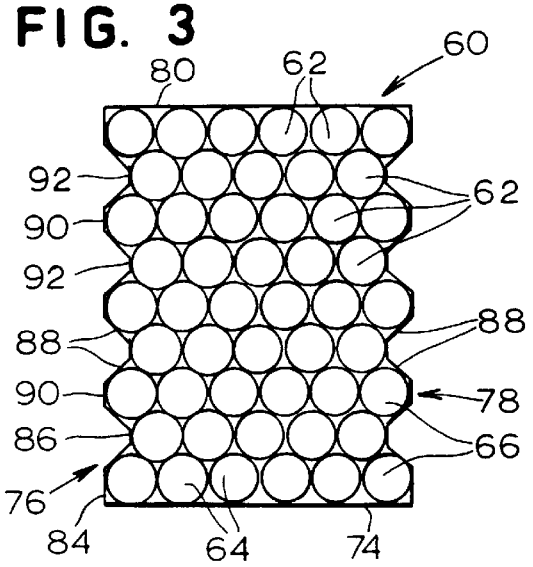
FIG. 3 is an end view of a casings caddy in accordance with the present invention.

Commercial cardboard caddies typically have two stacking arrangements: five rows of ten food casing sticks per row, or 9 rows of 6-5-6-5-6-5-6-5-6 stacking, both storing 50 food casing sticks.

As can be seen in the comparison between the prior art caddies of FIG. 1 and FIG. 2, using a conventional caliber 25 casing stick, with flatwidth of 34 mm, the shirred casing stick has a smooth diameter of about 23.5 mm. A caddy 30 cross section for 5×10 stacking, as in FIG. 1, would give a cross section of 23.5 cm×11.7 cm, or a 275 square centimeters cross sectional area. The casing sticks occupy a volume of 217 square centimeters, so the volumetric efficiency is 217 divided by 275=78.9%. There is, therefore, 21.1% free air in the caddy, allowing easy motion of the casing sticks. Also twenty-four of the casing sticks 32 are touching another casing on four sides, twenty-two casing sticks 34 touch another casing on three sides, and four corner casing sticks touch another casing on two sides. There are, therefore, 170 points of contact among the casing sticks, and 30 with the cardboard, for a total of 200 contact points, an average of 4.0 per casing stick.

With any lateral motion, the casing sticks on the outside of the rows can move. Since four points of contact are considered the minimum to assure stability, thirty of the two hundred contact points, or 15%, are with a flat cardboard surface that will fail to support casing sticks that have slightly smaller, but acceptable, outside diameters. This will happen in many cases because some casing sticks have a lower flatwidth, which results in the casing stick outer diameter dropping to as little as 22.4 mm in the case of the size 25 example given, and the casing sticks are very loose in the caddy, requiring bulking with additional packing, or accepting disruption of the stacking array.

FIG. 2 shows the alternate 6-5-6 packing, which in the size 25 casing produces a caddy 40 of 14.1 cm×19.5 cm, or 275 square centimeter cross sectional area. The casing sticks therefore occupy 78.9% of the volume, with free air accounting for 21.1% of the volume. However, casing stick support is improved: twenty-four casing sticks 42 have six-sided contact, eight casing sticks 44 have five-sided contact, eight casing sticks 46 have four-sided contact, six casing sticks 48 have three-sided contact, and four casing sticks 50 have two-sided contact. There is a total of 242 points of contact among the casings, and 22 with the cardboard, for a total of 264 contact points, or 5.28 per casing. Thus, FIG. 2 has improved casing-to-casing contacts by 21%, reduced casing-to-cardboard contacts by 27%, to provide better casing support where their outside diameter varies.

Although it is apparent that FIG. 2 offers better packing than FIG. 1, it has some deficiencies:

the logpile arrangement is easily disturbed, especially if the casing sticks are slightly less in diameter than planned, an everyday occurrence with normal casing size variations;

the casing sticks labeled 44 are constantly being pushed laterally by the vector components of the surrounding casing sticks, and have no cardboard wall restraint; and with any disruption in wall integrity, the casing sticks labeled 48 can easily fall down to the next lower level, since they experience three-sided lateral thrust.

The caddy 40 has a perimeter length of the caddy cross section of 14.1+14.1+19.5+19.5=67.2 cm, whereas FIG. 1 has 23.5+23.5+11.7+11.7=70.4 cm. Therefore, for casing sticks of the same length, the FIG. 2 caddy 40 uses 4.5% less cardboard then FIG. 1.

The arrangement of FIG. 2 provides for smaller cartons, less cardboard, and better casing support, but it is metastable and can easily be disrupted. Also, if the arrangement gets disturbed, dispensing can be more difficult for the customer, since the casings will cohere inside the caddy.

Nevertheless, it is desired to attain higher stability through alternating row configurations. It has been found, for example with U.S. Pat. No. 5,382,190 that when typical caddies are placed in a carton, for the caliber 25 casing dimensions above, would be a carton cross-section area of 1250 square centimeters for four caddies, one configuration, and 1172 square centimeters second configuration, compared to FIGS. 1 and 2 of 1100 square centimeters. So, although the hexagonal caddies have an apparent cardboard savings in the caddy, they could actually result in the use of more cardboard, of a heavier grade, for the outer carton, depending upon the final caddy arrangement inside the carton.

FIG. 2 still offers the ideal method to ship multiple caddies in a carton, as well as to provide minimum package size, least cardboard weight, etc. It uses the least weight of all sources of cardboard, and provides an easily-handled caddy shape.

The invention as illustrated in FIGS. 3 through 6 provides a caddy with improved lateral support for the food casing sticks therein and minimum package size. This support is made by bending cardboard inwardly slightly to define angular casing support surfaces to displace the free volume in the FIG. 2 arrangement and provide additional support for food casings at the ends of long rows of casings which in turn provide additional support for short rows of casings positioned between long rows of casings regardless of whether some of the casing sticks have smaller diameters. To bend the cardboard uniformly it may be desirable to perforate parallel lines in the cardboard before bending.

Figure 3B:
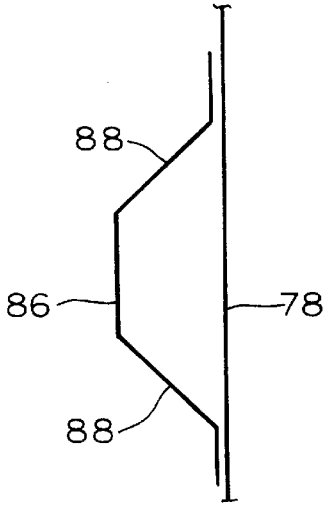
FIG. 3B is a partial view of a caddy side panel with a separate casing support surface.
Figure 3A:
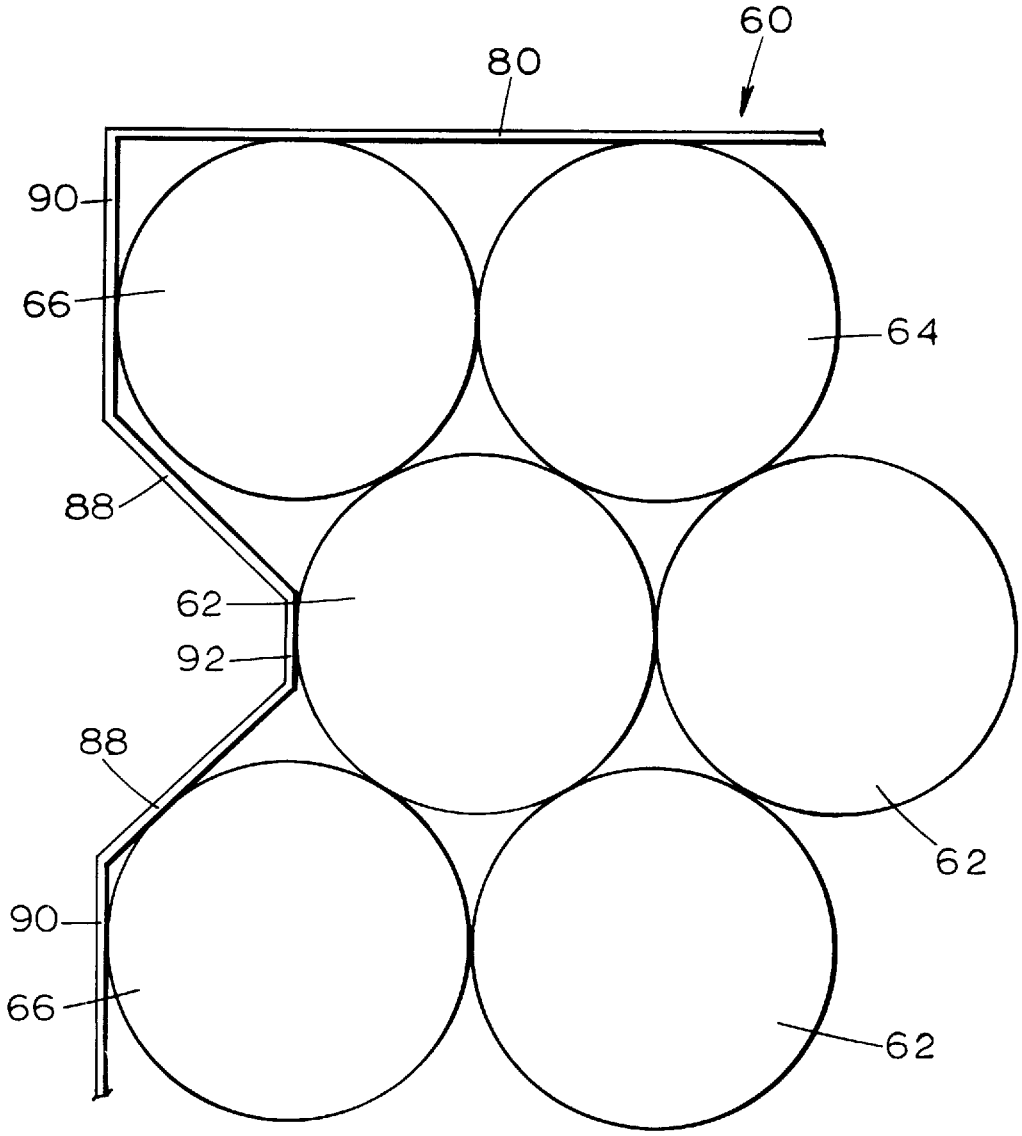
FIG. 3A is a partial view of a caddy side panel illustrating details of food casing-to-caddy contact points.

With the embodiment depicted in FIG. 3, a caddy 60 can store between twenty-four and thirty-two casing sticks 62 with six points of contact, between eight and sixteen casing sticks 64 with five points of contact, and eight and ten casing sticks 66 with four points of contact (see FIG. 3A). This modified caddy 60 provides more points of contact over the FIG. 2 embodiment, taking the total to 272 points, or 5.44 per casing stick. The casings are now more tightly compacted, yet the essential rectangular cross-sectional shape is maintained for minimizing air voids when several caddies are placed in a carton. These folds strengthen the caddy wall, and offer better casing support to maintain the stacking. Even if casing sticks move, they move only slightly before engaging a caddy support surface and the general configuration remains the same. Further, the outside caddy dimensions remain the same as FIG. 2.

This additional casing support is made possible using a caddy with a flat bottom panel 74, a first side panel 76 extending up from one edge of the bottom panel, a second side panel 78 extending up from an opposite edge of the bottom panel, and a flat top panel 80.

Each side panel includes a first row support surface 84 and a second row support surface 86 spaced inwardly from the first row surface 84 a dimension that is slightly greater than one-half diameter of a food casing. Angular support surfaces 88 provide additional support for the casings 66 on the ends of the long rows particularly, when the casing sticks vary in diameter and shift positions slightly.

Above the second row support surfaces 86 are alternating support surfaces 90 and 92 such that n casings fit between the first row support surfaces and alternating row surfaces 90, and n−1 food casings fit between the second row support surfaces 86 and alternating row support surfaces 92. In an ideal arrangement, the casing sticks will contact one another and the caddy 60 as illustrated in FIG. 3A. In such a caddy 60, the angular support surfaces 88 are likely not to be in contact with the casings. Nonetheless, each casing stick is provided with at least four points of contact, and most have six points of contact. In practice, the casing sticks will not be exactly uniform in diameter and the casing sticks at the ends of the rows may be supported by both the vertical and angular support surfaces 88, by the angular surfaces 88 only, or by the vertical surfaces only.

The angular support surfaces 88, the second row surfaces 86, and those surfaces in the same vertical plane 92 as the second row surfaces 86 may, but need not, be formed integrally with the other support surfaces. They can be formed of trapezoidal cardboard tubes or bent cardboard strips that are inserted into a rectangular caddy as the food casings are being inserted (FIG. 3B). Further, these surfaces can be straight or curved.

Figure 4:
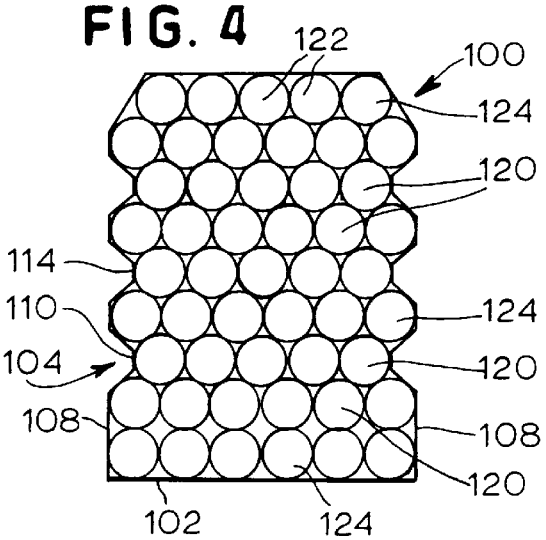
FIG. 4 is an end view of another casings caddy in accordance witth the present invention.

Another embodiment, illustrated in FIG. 4, recognizes that in the stacking pattern illustrated in FIG. 2 and FIG. 3 gravity plays a role and the most unstable layer is the top row. By placing two rows at the bottom, of six sticks each, the instability is alleviated and although depicted in FIG. 4 as having indentations, the caddy can be made with or without the indented casing support surfaces, as in FIG. 5.

As seen in FIG. 4, the caddy 100 includes a flat bottom panel 102 and two side panels 104 and 106 extending upward from opposite edges of the bottom panel 102. The side panels 104 and 106 each include a first and second row support surface 108 and a third row support surface 110 spaced laterally apart from the first and second support row surface 108 a dimension about equal to one-half of a food casing diameter. Above the third row surface 110 there are row support surfaces 112 vertically coplanar with the first and second row support surface 108, and alternating row support surfaces 114 that are vertically coplanar with the third row surface 110 such that n food casings fit in the first and second rows and n-1 casings fit in the third row. Above the third row, alternating rows of n and n-1 casings are stored.

There are angular support surfaces 118 spanning between the spaced apart rows which can provide more support for food casings at the ends of the rows with n casing sticks, particularly when the sticks have non-uniform diameters and have shifted slightly. Also, it is preferable to form all of the support surfaces from a single cardboard sheet, but separate support surfaces can be added to a flat panel, as described above relative to FIG. 3. As described above, the surfaces can be straight (as illustrated) or curved, so long as, at least the undersides of the casings at the ends of the long rows receive some additional support. Further, the third row surfaces and those coplanar therewith can be shaped to provide more support for the casings at the ends of the short rows although that support is unnecessary to obtain the advantages of the illustrated packing configuration.

In this embodiment, there are between twenty-one and twenty-six casings 120 with six-sided contact, seven to thirteen casings 122 with five-sided contact; and sixteen casings 124 with four-sided casing stick contact. Such an arrangement results in a total of between 255 and 271 contact points or an average of between 5.1 and 5.22 contact points per casing stick depending upon variations in casing stick diameters which dictates, in part, the number of support points provided by the caddy 130.

Figure 5:
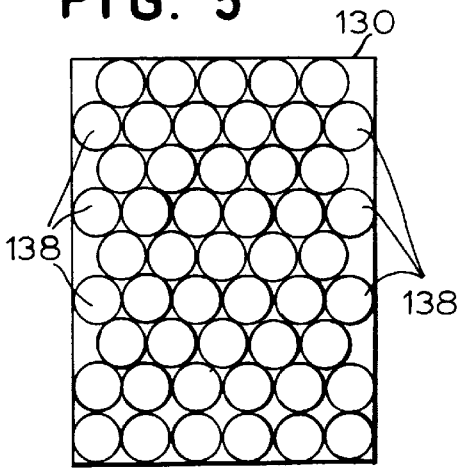
FIG. 5 is an end view of another casings caddy in accordance with the present invention.

In caddy 130 of FIG. 5, there are only six casing sticks 138 (second row from the bottom) that have reduced support from the lowest row of casing sticks. Although not ideal, this embodiment is more stable than the FIG. 2 embodiment and the cost for manufacturing the FIG. 5 caddy is less than the FIG. 4 embodiment which can provide greater stability.

If the indented wall is used, FIG. 4, there is virtually no chance of casing stick movement, but unlike FIG. 3 where four indentations per side are used, in FIG. 4 only three indentations per side are used, providing better economy of caddy manufacture. FIGS. 2, 3, 4, and 5 all have the same cross-sectional areas, and volumes.

Figure 6:
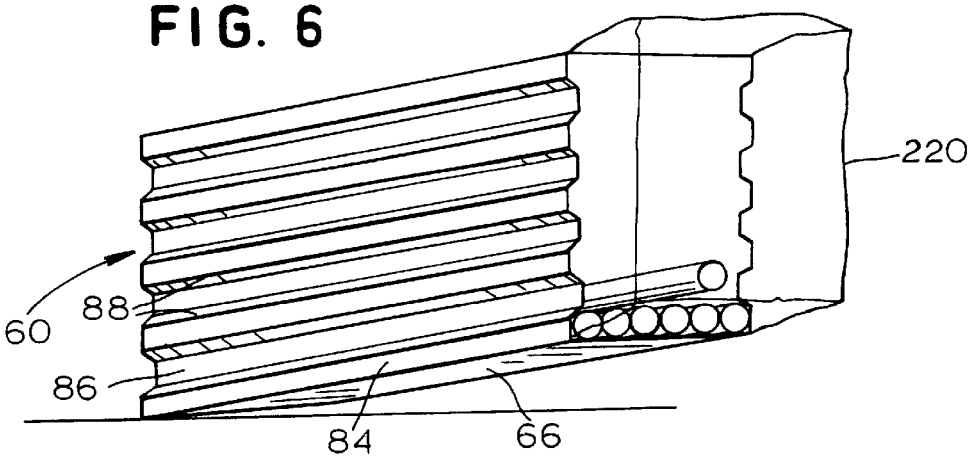
FIG. 6 is a perspective view of the casings caddy of FIG. 3 lined with a plastic sheet and being loaded with food casings.

Optionally, the shirred casing sticks can be placed inside a bag 220, and then placed into the caddy. With the indented sides, the casing sticks are guided somewhat into their proper position during loading. Consequently, the entire caddy can be packaged in a bag, either during loading from the top, or afterwards by placing the bag inside the caddy. This is the best method of ensuring the bag protects moisture if the caddy is exposed, alleviating the need for a secondary moisture liner inside the carton, for multiple caddies, as is the practice today (even with the plastic caddies such as patent U.S. Pat. Nos. 5,382,190, 4,381,643 or 5,228,572). FIG. 6 shows typical loading, into a plastic bag 220 placed inside the caddy. The casing sticks can be end-loaded easily, and the plastic bag sealed. Also, the plastic bag can be used to dispense the casings in the sausage kitchen alleviating any need for cardboard in the sausage kitchen.

The indentations can be made by prebending the sides or by adding the inner support surfaces separately (either loose or glued to the sides) into the caddy as guides to act as the dimples (FIG. 3A).

Also, the caddy can be sealed together by folding, such as in U.S. Pat. Nos. 3,028,952 or 3,321,072 two piece telescoping, such as U.S. Pat. Nos. 3,342,322 or 3,616,989 shrink overwrap, such as U.S. Pat. No. 3,764,351; or connected with adhesive tape, or wrapped in an elastic band.

Dispensing can be from the side, or top, depending upon the exact cardboard pattern selected.

Another embodiment (not illustrated) is to use very light weight cardboard, and overwrap the indented sides with extra cardboard. This provides reinforcement, so the indentations resist outward deflection yet ensure no heavier mass of cardboard is being used.

The foregoing detailed description is provided for clearness of understanding only, and no unnecessary limitations therefrom should be read into the following claims.

I claim:

1. A caddy for storing and shipping at least four shirred food casings rows such that the number of food casings in each row alternate such that n food casings can be positioned in a first row and a third row, and n−1 food casings can be positioned in a second row and a fourth row, all of the casings are substantially equal in diameter and length with their longitudinal axes substantially parallel and their ends substantially coplanar, the caddy comprising:

a substantially flat bottom panel adjacent the first row having a first edge and a second edge;

a first side panel extending upward from the bottom panel first edge and having a first row support surface adjacent the bottom panel, and an angular surface extending upwardly and inwardly from the first row support surface on said first side panel the longitudinal axis of which is parallel with said flat bottom panel;

a second side panel extending upward from the bottom panel second edge and having a first row support surface adjacent the bottom panel, and an angular surface extending upwardly and inwardly from the first row support surface on said second side panel the longitudinal axis of which is parallel with said flat bottom panel; and a substantially flat top panel joined to the first and second side panels.

2. The caddy of claim 1 in which each of the side panels further comprises:

a second row casing support surface extending upwardly from the angular support surface.

3. The caddy of claim 2 in which each of the side panels further comprises:

a second angular support surface extending upwardly outwardly from the second row support surface.

4. The caddy of claim 1 in which the side panels are constructed of cardboard.

5. The caddy of claim 1 in which each side panel angular surface is formed integrally with the first row support surface.

6. The caddy of claim 1 in which each side panel angular surface is formed separately from the first row support surface, and secured to the side panel.

7. A caddy for storing and shipping a plurality of rows of shirred food casings such that n food casings can be stored in first and second rows, and n−1 food casings can be stored in a third row, and all of the casings are of substantially equal diameter and length with the longitudinal axes substantially parallel and their ends substantially coplanar, the caddy comprising:

a substantially flat bottom panel having a first edge and a second edge;

a first side panel extending substantially perpendicular from the first edge of the flat panel, having a first and second row support surface, and an angular surface joined to the first and second row support surface on said first side panel the longitudinal axis of which is parallel with said flat bottom panel; and a second side panel extending substantially perpendicularly from the second edge of the flat panel, having a first and second row support surface, and an angular surface joined to the first and second row support surface on said second side panel the longitudinal axis of which is parallel with said flat bottom panel.

8. The caddy of claim 7 in which each of the side panels further comprises:

a third row casing support surface spaced laterally inwardly from the first and second row support surface to at least partially support a casing at an end of the third row.

9. The caddy of claim 8 in which each of the side panels further comprises:

a second angular support surface joined to and extending outwardly from the third row support surface.

10. The caddy of claim 7 in which the side panels are constructed of cardboard.

11. The caddy of claim 7 in which each side panel first and second row support surface is formed integrally with the angular surface.

12. The caddy of claim 7 in which each side panel angular surface is formed separately from the first and second row support surface.

13. The caddy of claim 1 which is capable of storing and shipping at least eight shirred food casing rows.

14. The caddy of claim 7 which is capable of storing and shipping at least eight shirred food casing rows.

15. A caddy for storing and shipping at least four shirred food casings rows such that the number of food casings in each row alternate such that n food casings can be positioned in a first row and a third row, and n−1 food casings can be positioned in a second row and a fourth row, all of the casings are substantially equal in diameter and length with their longitudinal axis substantially parallel and their ends substantially coplanar, the caddy comprising:

a substantially flat bottom panel adjacent the first row having a first edge and a second edge;

a first side panel extending upward from the bottom panel first edge and having a first row support surface adjacent the bottom panel and an angular surface extending upwardly and inwardly from the first row support surface, a second side panel extending upward from the bottom panel second edge and having a first row support surface adjacent the bottom panel, and an angular surface extending upwardly and inwardly from the first row support surface, a substantially flat top panel joined to the first and second side panels; and a plastic sheet liner conforming to the shape of the caddy, and having a seal flap for folding over shirred food casings.

16. A caddy for storing and shipping a plurality of rows of shirred food casings such that n food casings can be stored in first and second rows, and n−1 food casing can be stored in a third row, and all of the casings are of substantially equal diameter and length with the longitudinal axis substantially parallel and their ends substantially coplanar, the caddy comprising:

a substantially flat bottom panel having a first edge and a second edge;

a first side panel extending substantially perpendicular from the first edge of the flat panel, having a first and second row support surface, and an angular surface joined to the first and second row support surface, a second side panel extending substantially perpendicularly from the second edge of the flat panel, having a first and second row support surface and an angular surface joined to the first and second row support surface; and a plastic sheet liner conforming to the shape of the caddy, and having a seal flap for folding over shirred food casings.

* * * * *